US008911174B2

(12) United States Patent
Hey et al.

(10) Patent No.: US 8,911,174 B2
(45) Date of Patent: Dec. 16, 2014

(54) WATERCRAFT LIFT AND AUTOMATIC WATER CRAFT COVER

(71) Applicant: Sunstream Corporation, Kent, WA (US)

(72) Inventors: Kenneth Edwards Hey, Mercer Island, WA (US); Harry Millan, Jr., Federal Way, WA (US); Jeffrey Alan Hart, Kent, WA (US); Loern Alan Halverson, Bellevue, WA (US)

(73) Assignee: Sunstream Corporation, Kent, WA (US)

( * ) Notice: Subject to any disclaimer, the term of this patent is extended or adjusted under 35 U.S.C. 154(b) by 0 days.

(21) Appl. No.: 13/624,810

(22) Filed: Sep. 21, 2012

(65) Prior Publication Data

US 2013/0266377 A1 Oct. 10, 2013

Related U.S. Application Data

(60) Provisional application No. 61/537,454, filed on Sep. 21, 2011, provisional application No. 61/590,734, filed on Jan. 25, 2012.

(51) Int. Cl.
*B63C 3/06* (2006.01)
*E04H 6/04* (2006.01)

(52) U.S. Cl.
CPC ... *B63C 3/06* (2013.01); *E04H 6/04* (2013.01)
USPC ..... 405/3; 114/361

(58) Field of Classification Search
USPC ..... 405/3–7; 114/361
See application file for complete search history.

(56) References Cited

U.S. PATENT DOCUMENTS

| | | | | |
|---|---|---|---|---|
| 3,549,198 | A | 12/1970 | Cappello | |
| 4,019,212 | A | 4/1977 | Downer | |
| 4,740,029 | A * | 4/1988 | Tuerk | 296/100.15 |
| 5,269,332 | A * | 12/1993 | Osborne | 135/88.01 |
| 5,292,169 | A | 3/1994 | O'Brian | |
| 5,709,501 | A | 1/1998 | Elbers | |
| 5,769,105 | A | 6/1998 | Margol et al. | |
| 5,813,360 | A * | 9/1998 | Dickey, Jr. | 114/161 |
| 6,688,252 | B1 | 2/2004 | Caravella | |
| 6,786,171 | B1 | 9/2004 | Elbers | |
| 7,001,104 | B2 * | 2/2006 | Edson | 405/3 |
| 7,194,976 | B1 | 3/2007 | Kramer | |
| 7,527,014 | B2 * | 5/2009 | Hey et al. | 114/361 |
| 2005/0016438 | A1 | 1/2005 | Hey et al. | |
| 2012/0180714 | A1 | 7/2012 | Bir, Jr. | |

* cited by examiner

*Primary Examiner* — Thomas B Will
*Assistant Examiner* — Katherine Chu
(74) *Attorney, Agent, or Firm* — Davis Wright Tremaine LLP; George C. Rondeau, Jr.

(57) ABSTRACT

A watercraft lift with hydraulically actuated arms which self-installs a fitted three-dimensional boat or other watercraft cover on a powerboat or other watercraft. Control logic allows for cover operation only when the lift is raised, and has a single control for both the lift and cover system. A spring-tensioned roller keeps the cover tight and self-rolls the cover on the roller when the actuated arms are pivoted forward. The roller is hidden behind the watercraft when in a "cover-on" position.

46 Claims, 8 Drawing Sheets

WATERCRAFT LIFT AND AUTOMATIC WATER CRAFT COVER

CROSS REFERENCE TO RELATED APPLICATION(S)

This application claims the benefit of U.S. Provisional Patent Application Nos. 61/537,454 filed Sep. 21, 2011 and 61/590,734 filed Jan. 25, 2012.

BACKGROUND OF THE INVENTION

1. Field of the Invention

The present invention relates to free-standing watercraft lifts and watercraft covers for use with watercraft lifts.

2. Description of the Related Art

The use of boat covers to protect boats is well known. A number of designs are currently known to perform this basic operation. Many boats have multi-section covers, often with one covering the bow section and another covering the aft section. The covers are typically shaped to cover at least portions of the three-dimensional shape of a boat and are manually spread out over the boat and then manually attached using snap or other fasteners. The bow section is attached with fasteners around the perimeter of the bow section especially when there is a bow opening. The aft section is attached to fasteners on the windshield, or in front of the windshield, as well with fasteners around the perimeter of the aft section. This common cover system has several negative aspects for the user. The large number of snaps or other fasteners used make the covers time consuming to install. The covers are often difficult to install after the material ages. The covers are large and awkward to store on-board. The covers can be dirty, and unpleasant to handle. The covers tend to lose shape, causing pockets of water, which further cause a loss of shape and pools of water. The covers do not cover a significant amount of hull surface surrounding the covers, and do not cover significant portions of the sides of the boat with which used, which allows fading in the sun and fails to protect these areas from dirt. The covers provide no security, which makes the contents of the boat and the boat itself vulnerable to theft.

Several two-dimensional automatic cover designs are currently known. U.S. Pat. No. 3,549,198 uses a rotating arm to pull a flat cover over the top of a dump truck to secure the contents. This design would not be ideal for use with a boat lift since the cover is two-dimensional, non-adjustable and would be impractical to fit the three-dimensional shapes of various boat types with which the lift might be used.

It is known to use a two-dimensional cover design similar to that of U.S. Pat. No. 3,549,198 on a portable boat lift for a pontoon boat. However, this design does not provide protection for the sides of the boat. It also is more vulnerable to side wind, since it has exposed edges that catch the wind. The design use a roller fixed to the front, and a set of arms which pull the cover rearward like a window shade. This type of design is undesirable for application on a boat, since pulling the cover rearward from a fixed roller at the front of the boat lift would cause the cover to slide over and drag on parts of the boat, causing cover wear, and potential boat damage. The fixed cover in the front also blocks views and is not attractive since the roller remains visible at the front even when the cover is deployed. Further, the lift of U.S. Pat. No. 3,549,198 does not provide any protection against operation of the lift when the cover is deployed, which can cause cover and/or boat damage, especially if installed on lifts that translate rearward when lowering, such as the lift of U.S. Pat. No. 5,908,264. Since the lift of U.S. Pat. No. 3,549,198 is not remote controlled, another drawback results from the user being required to operate it from the location of a control box. This does not permit manually adjusting the cover when operating in situations where it is not seating correctly.

U.S. Pat. Nos. 4,019,212 and 6,786,171 describe a cover system that does not touch the boat. These systems have a fixed roof with structure and retractable sides that completely surround the boat. The tall sides of these systems block views and are more vulnerable to wind. For use on a free-standing boat lift, the fixed roof structure can make the lift vulnerable to tipping. Because of the fixed roof, these systems often require permitting and are highly regulated.

U.S. Pat. No. 4,019,212 is a device that attaches to a free-standing boat lift and lifts the cover off vertically. This design requires an external frame and overhead structure to lift the frame. The design is not conducive to cover the full sides of the boat. Since the cover creates a shadow over the water even when the boat is off the lift, this design would often be regulated as a canopy or covered moorage rather than as a boat cover.

BRIEF DESCRIPTION OF THE SEVERAL VIEWS OF THE DRAWING(S)

DETAILED DESCRIPTION OF THE INVENTION

Figure 1:
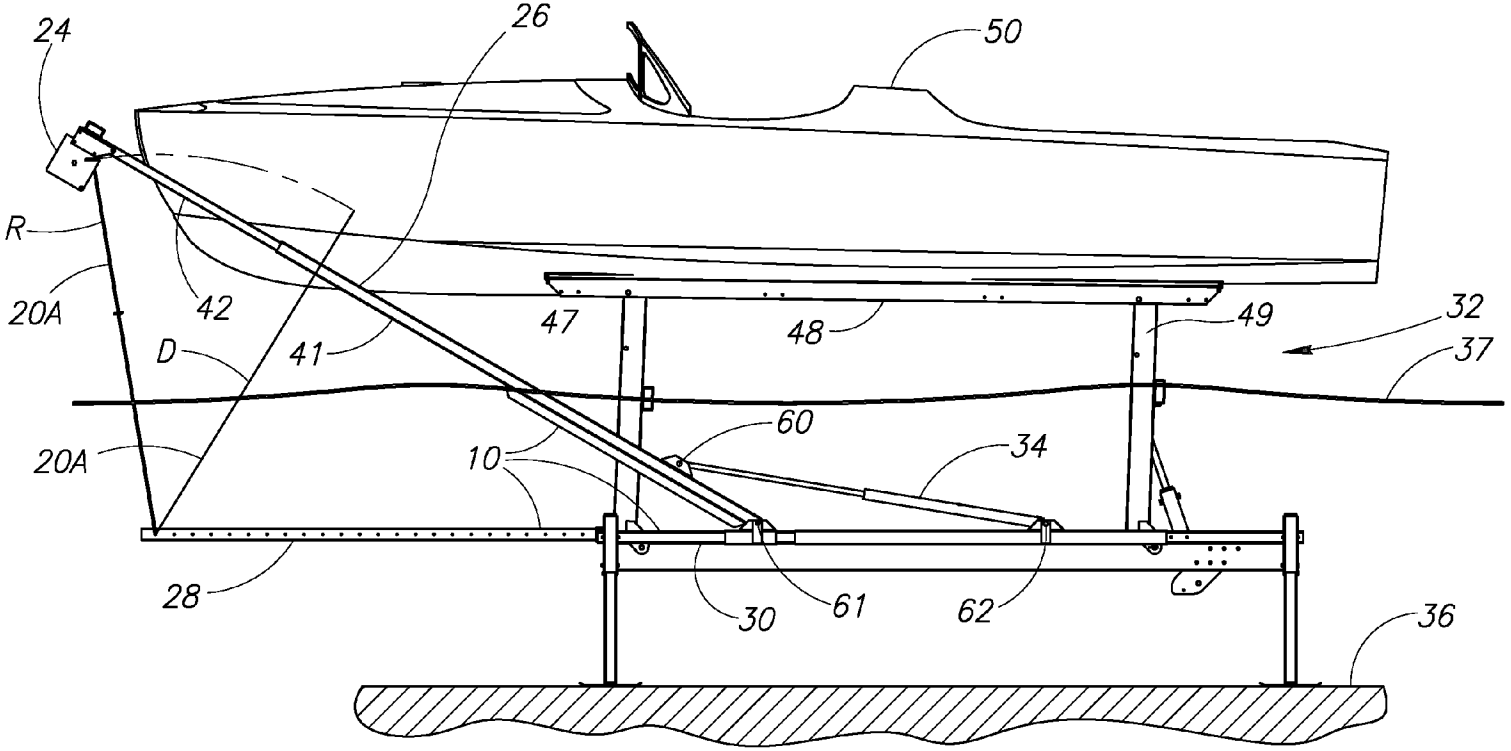
FIG. 1 is a side view of a boat on a lift in accordance with an embodiment of the present invention with the cover in an 'Off' position.

The invention generally relates to a free-standing watercraft lift system, generally lifting powerboats under 30 feet long, however, the design may be applied to other type and size boat and watercraft lift systems and other type and size boats and watercraft.

The disclosed embodiments of the invention are illustrated for a free-standing boat lift that allows for simple installation and removal of the cover, better protection for the boat, less view blockage, and better theft prevention. The combination of these features saves the boater time before and after boating, reduces hull cleaning, reduces hull fading, and allows the owner to store equipment, such as water skis inside the boat more securely; although achieving any one of these attributes alone is beneficial.

As shown in the drawings for purposes of illustration, a boat 50 is supported by a free-standing boat lift 32 using port and starboard (left and right side) boat lift bunks 48. The lift may use rollers or other means for supporting the boat thereon. The boat lift 32 includes port and starboard forward lift legs 47 and port and starboard rearward lift legs 49 which are pivotally connected directly or indirectly through cross-beams or otherwise to port and starboard side rails 30 of the frame of the boat lift 32. One or more hydraulic cylinders is provided to rotate the port and starboard rearward lift legs 49, and hence also port and starboard forward lift legs 47 and raise and lower the port and starboard boat lift bunks 48, with and without the boat 50 thereon. The boat lift 32 has feet pads which rest upon the seabed 36 or other bottom surface on which the boat lift is placed, and is partially submerged below the water line 37.

Figure 7:
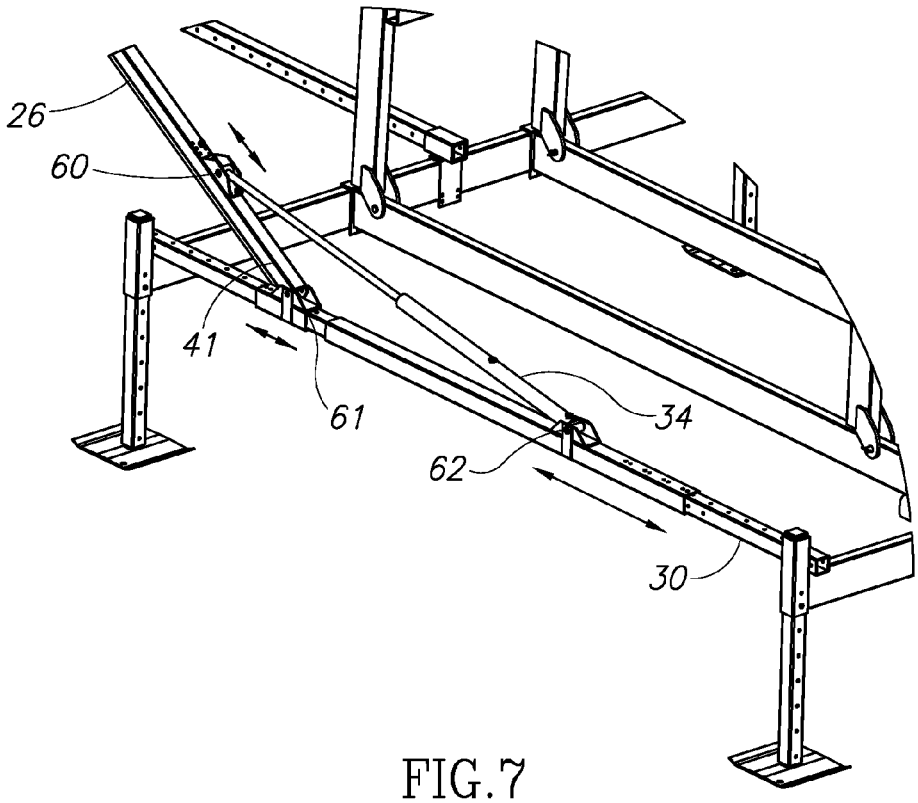
FIG. 7 is a fragmentary port side view of the lift illustrating the adjustable swing arm of the lift.

Port and starboard swing arms 26 are, respectively, pivotally connected to the port and starboard side rails 30 at port-side and starboard-side pivot locations 61 (see FIG. 7), and are each simultaneously moved by operation of a corresponding port and starboard hydraulic cylinder 34. Each of the port and starboard swing arms 26 includes a base arm portion 41 and an upper arm portion 42 telescopically disposed with respect to the base arm portion and by which the length of the swing arm can be selectively adjusted to fit the boat 50 with which the boat lift 32 is being used. In the illustrated embodiment, the upper arm portions 42 telescopes internal to the base arm portion 41 of each of the port and starboard swing arms 26 and the length of swing arm is adjusted by sliding the upper arm portion to extend it from or retract it within the base arm portion. When moved sufficiently to provide the desired length of the swing arm, the upper arm portion 42 is then secured relative to the base arm portion 41 using a pin or other fastener. An arm stiffener 27 is attached to each of the base arm portions 41 of the port and starboard swing arms 26.

The port hydraulic cylinder 34 has a lower end pivotally connected to the port side rail 30 or another frame member of the boat lift 32 at port-side pivot location 62, and an upper end pivotally connected to the port swing arm at port-side pivot location 60 on the port-side base arm portion 41. The starboard hydraulic cylinder 34 has a lower end pivotally connected to the starboard side rail 30 or another frame member of the boat lift 32 at starboard-side pivot location 62, and an upper end pivotally connected to the starboard swing arm at starboard-side pivot location 60 on the starboard-side base arm portion 41. In an alternative embodiment not illustrated, a single hydraulic cylinder may be used to simultaneously move the port and starboard swing arms 26. In another alternative embodiment not illustrated, the swing arms may be pulled rearward with a cable.

A roller or roller tube 24 extends laterally between and is rotatable relative to the upper end portions of the upper arm portions 42 of the port and starboard swing arms 26. A torsional spring is positioned within the roller tube 24 and applies adjustable rotation force to the roller tube to wrap/roll or furl a cover 22 attached thereto about the roller tube, and apply a pulling force to the cover attached thereto. As the roller tube 24 is carried forward by the swing arms 26 from a rearward position at the aft of the boat 50 toward the bow of the boat, the torsional spring operates to wrap the cover 22 about the roller tube in a first direction (counterclockwise when viewed from the port side). In an alternative embodiment, the torsional spring may be replaced by a hydraulics motor which suppies the rotation force to the roller tube.

An anti-racking bar 25 is attached to and extends between the upper end portions of the upper arm portions 42 of the port and starboard swing arms 26 rearward of the roller tube 24 to reduce racking between the swing arms.

Figure 2:
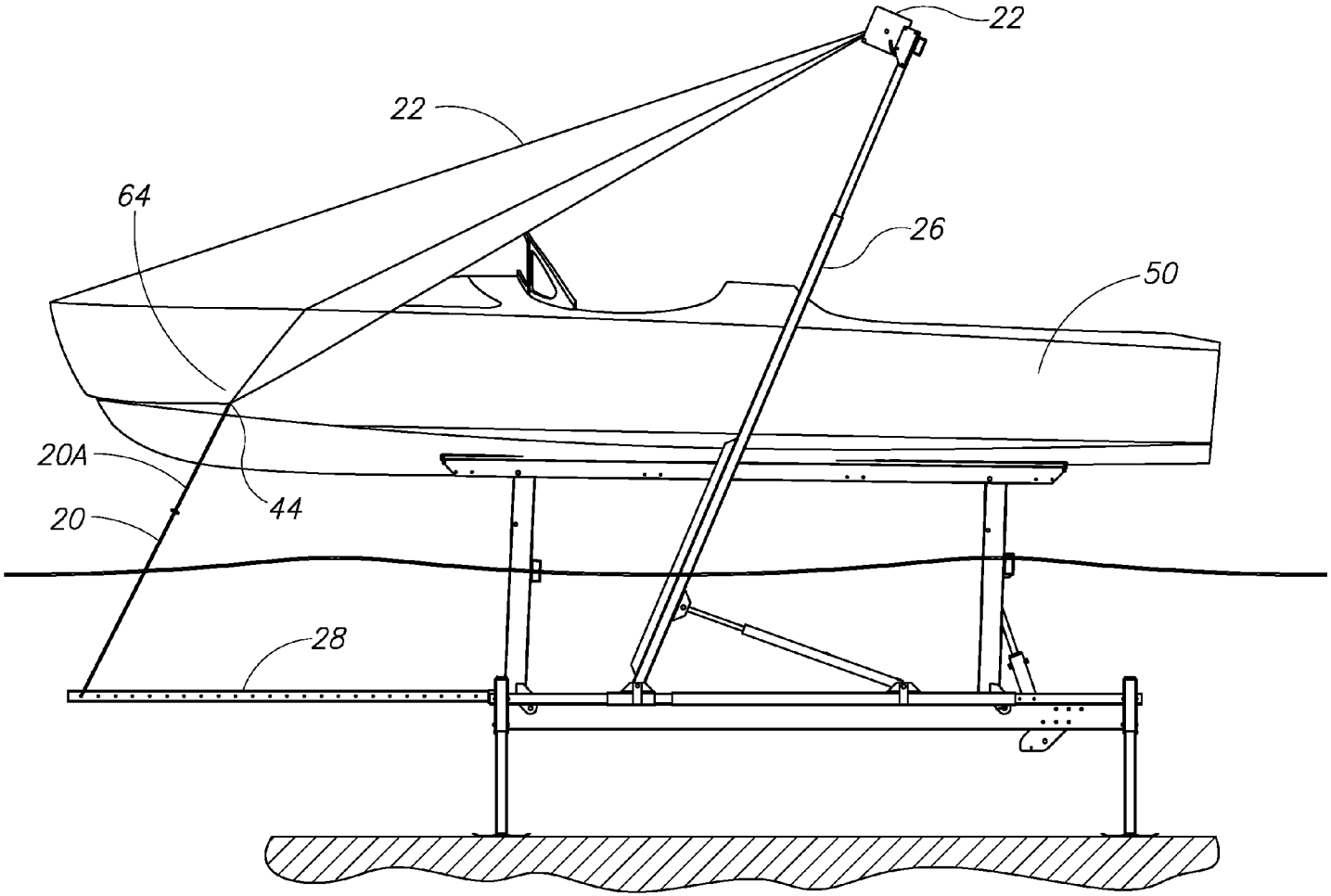
FIG. 2 is a side view of the boat on the lift with the cover in a 'Partially On' position.

A forward portion of the cover 22 has a bow pocket sized to accept therein the bow of the boat 50 when the cover is deployed to cover the boat (see FIG. 2). Forward cover lines 20 extend between the forward portion of the cover and a forward end portion of an elongated bow sprit 28 which has a rearward end portion attached to a forward transverse frame beam 46 of the boat lift 32 (see FIG. 4). The bow sprit 28 is located below the water line 37 in the illustrated embodiment. Also, in the illustrated embodiment, the forward cover lines 20 include a port forward cover line 20A extending between an attachment point 44 of the forward potion of the cover on its port side and the forward end portion of the bow sprit 28, and a starboard forward cover line 20B extending between an attachment point 45 of the forward portion of the cover on its starboard side and the forward end portion of the bow sprit. In the preferred embodiment, the port forward cover line 20A is attached to a port forward wing portion 64 of the cover 22 and the starboard forward cover line 20B is attached to a starboard forward wing portion 65 of the cover. In FIG. 1, the port forward cover line 20A is depicted both in the retracted position "R" and in the deployed position "D". Positioning the lower section of the port and starboard forward cover lines 20A and 20B nearly under the forward position of the roller tube 24 allows the nose of the cover to mostly roll on the roller tube.

Another embodiment uses a line extending from the port and starboard attachment points 44 and 45 on the cover 22 to the boat lift frame directly, without using a bow sprit, such as to the forward transverse frame beam 46 of the boat lift 32 or to a bow stop accessory that mounts to the boat lift bunks 48. Another embodiment uses a single forward cover line attached to the front end of the forward portion of the cover 22 and to a forward portion of the frame of the boat lift 32. In yet another embodiment, the forward portion of the cover may be secured to a structure in front of the bow of the boat such as a dock or an anchor, and the bow pocket may be eliminated.

Figure 4:
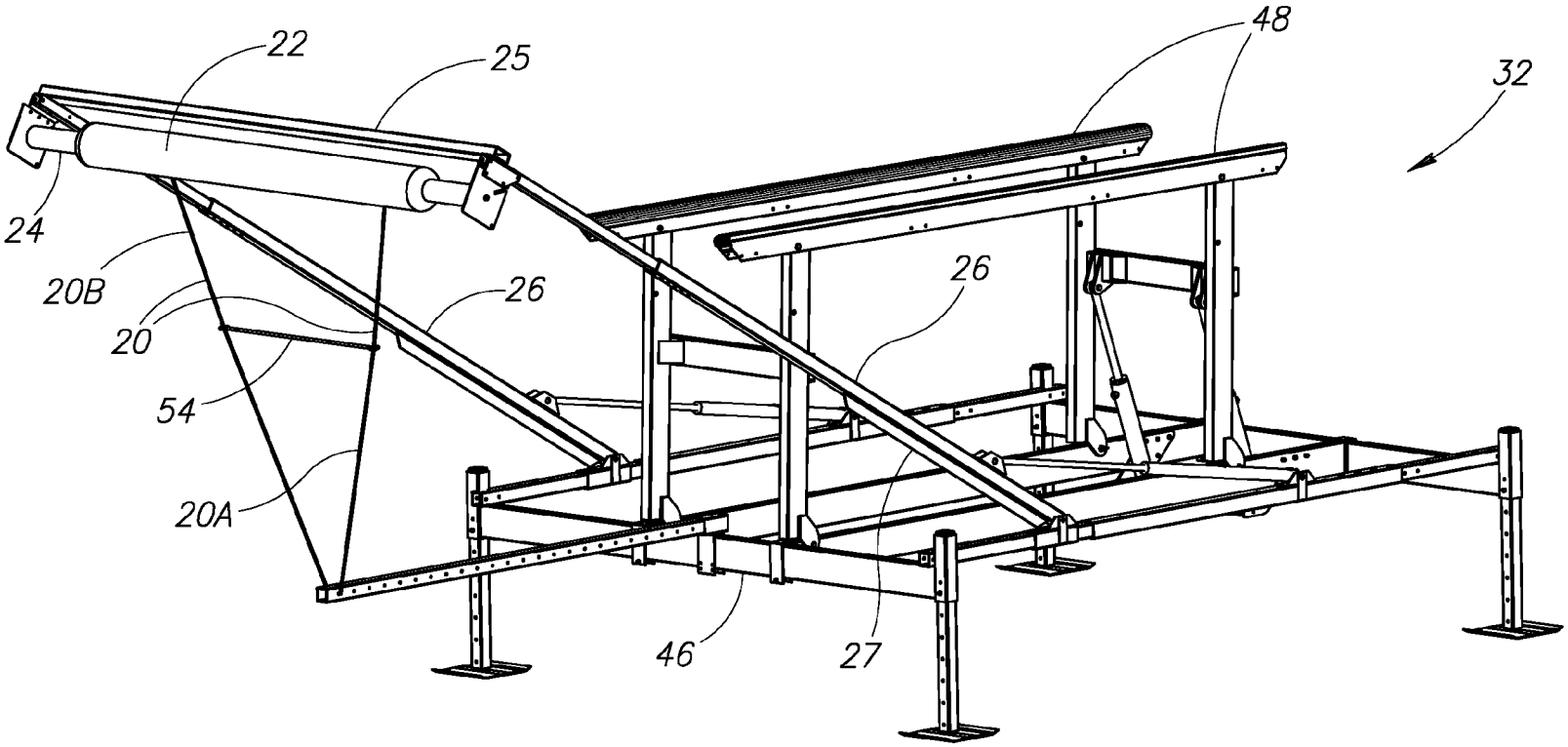
FIG. 4 is an isometric view of the lift and the cover without the boat.

As shown in FIG. 4, a spreader bar 54 extends between and is connected to the port and starboard forward cover lines 20A and 20B, at a position above the bow sprit 28, to assist in laterally separating the port and starboard forward cover lines and preventing the cover 22 from snagging when the cover is used on a wide-bow boat. The spreader bar 54 may also be mounted directly on the bow sprit 28, with the lower ends of the port and starboard forward cover lines 20A and 20B attaching directly to the spreader bar.

Figure 6:
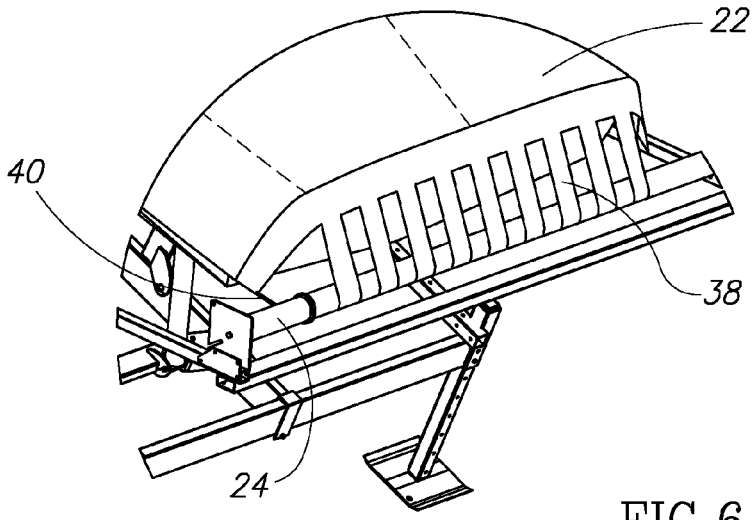
FIG. 6 is an isometric rear view of the lift with the boat and the cover in the fully deployed position, showing rear details of cover.

As shown in FIG. 6, an aft portion of the cover 22 is attached to the roller tube 24 with a multiplicity of elastic members 38, such as cords or straps, to assist in keeping cover 22 tight on the boat 50 and connect the cover to the roller tube. The elastic members 38 are wrapped around the roller tube 24 in a first direction as is the cover 22 when carried forward by the swing arms 26 from a rearward position at the aft of the boat 50 toward the bow of the boat, as described above.

The perimeter of the cover 22 has a longitudinally extending edge pocket with an elastic cord 40 extending through the pocket (see FIG. 6 showing an aft portion thereof). Port and starboard aft ends of the elastic cord 40 are wrapped around the roller tube 24 in a second direction opposite to the first direction (clockwise when viewed from the port side). When the roller tube 24 is carried rearward by the swing arms 26 from a forward position at the bow of the boat 50 toward the aft of the boat, the cover 22 is unfurled and deployed over boat 50. At the same time the elastic cord 40 is tightened as a result by being wrapped around the roller tube 24 in the opposite second direction than the elastic members 38 and the cover 22 so that the elastic cord 40 is tensioned when the roller tube is pulled aft to keep the lower edges of the cover 22 taut, and the elastic cord is loosened when roller tube moves forward and the cover is rolled up on the roller tube.

Figure 3:
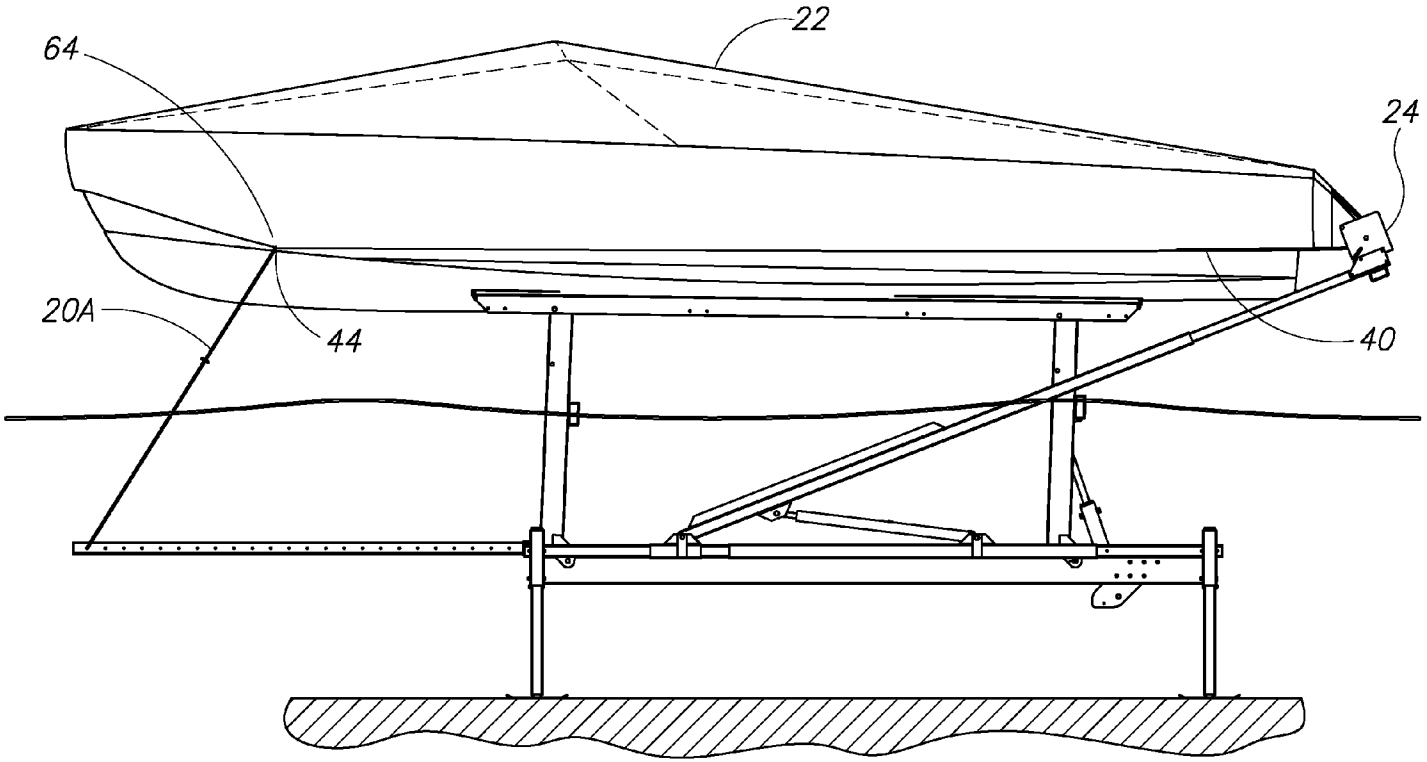
FIG. 3 is a side view of the boat on the lift with the cover in an 'On' or fully deployed position.

The port and starboard forward side wings 64 and 65 of the cover 22 are included in the preferred embodiment to better secure the cover to the sides of the boat. The cover 22 is shown fully deployed in FIG. 3. As shown in FIG. 3, when fully deployed the sides of the cover 22 extend downward substantially to or below the chine of the boat 50.

Figure 5:
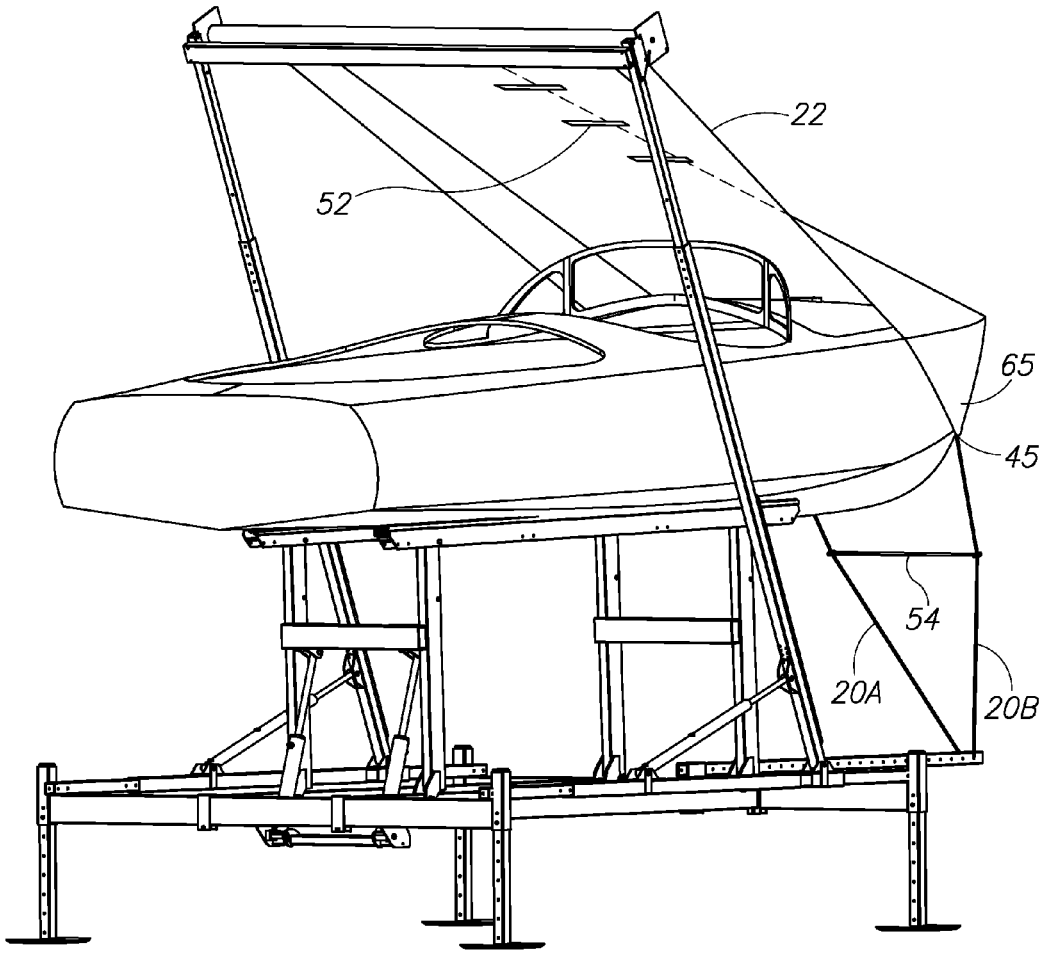
FIG. 5 is an isometric view of the lift and the cover with the boat and showing inner handles of the cover.

The cover 22 has a plurality of interior handles 52 (see FIG. 5) which assist an operator in manually positioning the cover over the boat 50 or adjusting the position of the cover on the boat, if needed.

The angular range of swing of the swing arms 26, as well as the starting and ending positions of the roller tube 24 carried by the swing arms, can be adjusted by adjusting the positions of the pivot locations 60 where the upper ends of the port and starboard hydraulic cylinders 34 are pivotally attached to the base arm portions 41 of the port and starboard swing arms 26 along the length of the base arm portions, the positions of the pivot locations 62 where the lower ends of the port and starboard hydraulic cylinders are pivotally attached to the port and starboard side rails 30 along the length of the side rails (see FIG. 7), and the extend the upper arm portions 42 extend telescopically for the base arm portions 41 of the port and starboard swing arms 26. The base arm portions 41 of the port and starboard swing arms 26 each include a channel with multiple locations along which the upper ends of the port and starboard hydraulic cylinders, respectively, can be selectively and adjustably, pivotally attached. Similarly, the port and starboard side rails 30 each include a channel with multiple locations along which the lower ends of the port and starboard hydraulic cylinders, respectively, can be selectively and adjustably, pivotally attached.

Figure 8:
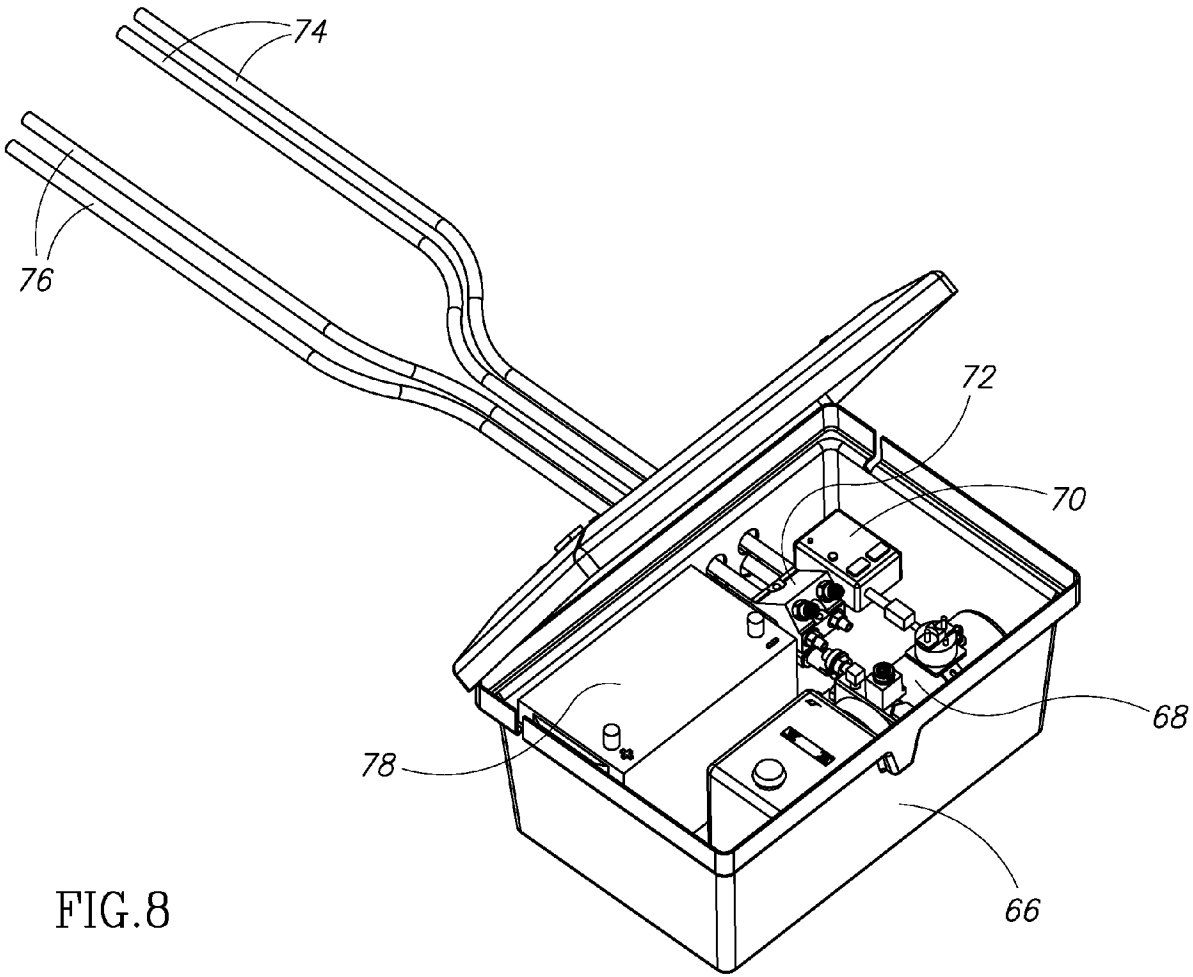
FIG. 8 is an isometric view of a hydraulic powerpack of the lift.

A hydraulic powerpack 66, which includes a control box within which its components are position, as shown in FIG. 8, operates the boat lift 32. In the preferred embodiment, a particular sequence is used for both operation of the boat lift to raise and lower the boat 50 and movement of the swing arms 26 to furl and unfurl the cover on the roller tube 24. Only after the boat lift is in a substantially fully raised position, the control system switches and then permits control of the cover, and the cover 22 can then be moved from the 'Off' position to the 'On' position. When the cover is substantially fully retracted (furled around the roller tube 24) to the 'Off' position, the control again shifts to allow operation of the boat lift to lower and raise the boat.

In the preferred embodiment, the switching of control can be done hydraulically with a sequence valve and a counterbalance valve which automatically switch the system between a 'Lift mode' and a 'Cover mode'. The system switches from 'Lift mode' to 'Cover mode' using a sequence valve that shifts when the lift reaches the substantially fully raised position. The system switches back to the 'Lift mode' using a counterbalance valve that shifts when the cover is substantially fully removed which occurs when the port and starboard hydraulic cylinders 34 are substantially fully extended to position the roller tube 24 at the forward end of the boat 50 with the cover 22 furled thereabout.

The hydraulic powerpack 66 includes a hydraulic power unit 68, a control box 70, a hydraulic switching manifold 72 and a battery 78. The hydraulic powerpack 66 is connected to hydraulic cylinders which move port and starboard forward and rearward lift legs 47 and 49 to lift and lower the boat lift bunks 48, and hence the boat 50, by hydraulic hoses 74. The hydraulic powerpack 66 is connected to the port and starboard hydraulic cylinders 34 which move the swing arms 26, and hence the cover 22, by hydraulic hoses 76. The hydraulic hoses 74 and 76 are connected to the hydraulic switching manifold 72. The battery 78 powers the hydraulic power unit 68 and the control box 70 operates the hydraulic power unit 68. The hydraulic switching manifold 72 selectively directs the hydraulic fluid flow to the hydraulic hoses 74 for the lift or the hydraulic hoses 76 for the cover system. The control box 70 can be operated by a manual two way switch or with a remote control.

Figure 9:
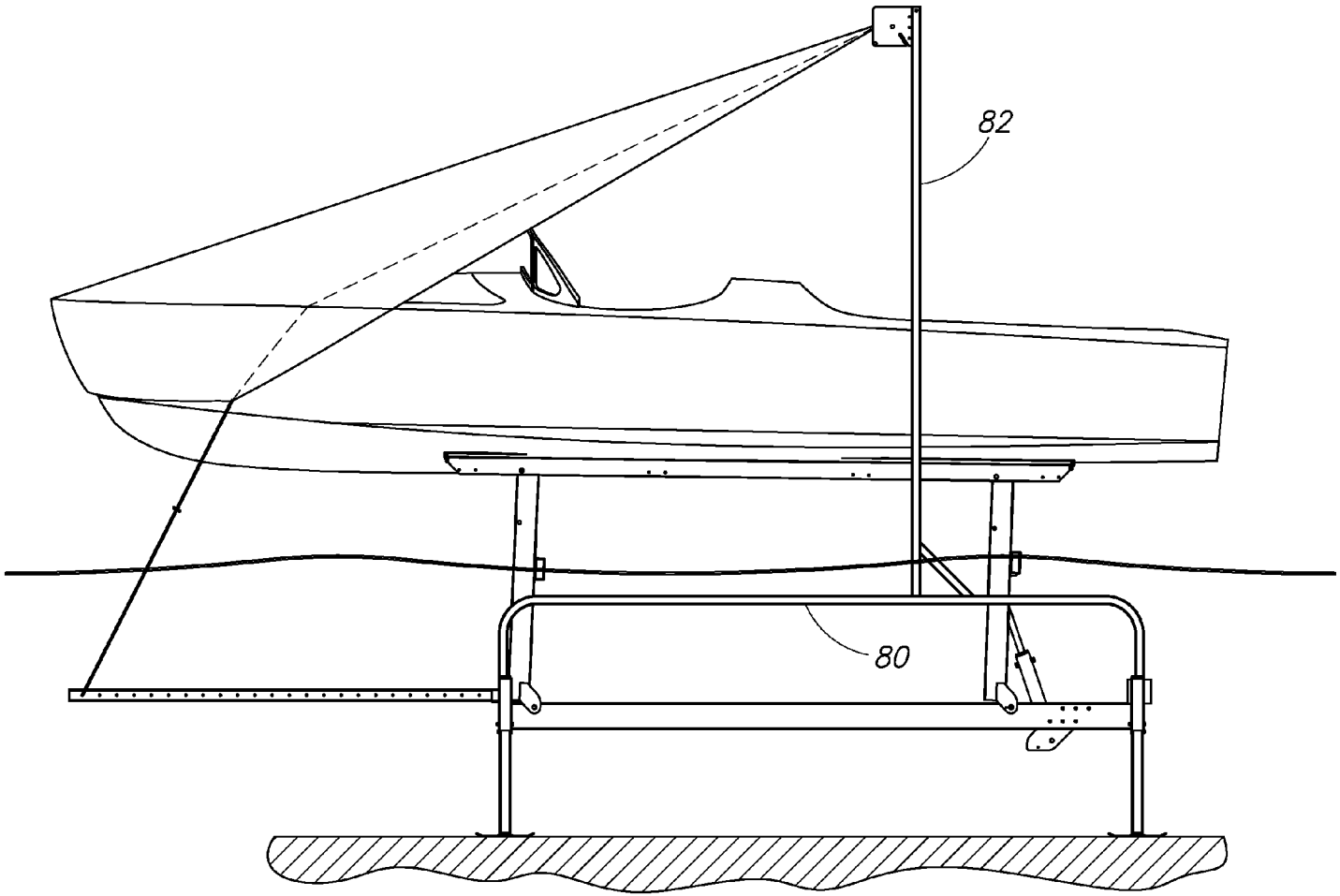
FIG. 9 is a side view of an alternative embodiment of the present invention.

An alternative embodiment of the boat lift 32 is shown in FIG. 9 where the port and starboard swing arms 26 have been replaced by an arm 82 that translates forward and rearward on a track 80. In this embodiment the roller tube 24 is moved from near the bow of the boat 50 to near the aft of the boat using the arm 82 carrying the roller tube 24 at an upper end of the arm. The front and rear portions of the track 80 are curved downward to drive the roller tube 24 downward as the arm 82 reaches the front and rear portions of the track. This embodiment requires less overhead space, which makes it suitable for applications under a boat house roof. Another embodiment has the roller tube 24 translating directly on a track, and being pulled rearward by a cable.

The cover system of the present invention may be applied with modification to various boat supports, including floating lifts, piling mounted cable lifts, trailers, yacht dingy deck cradles, boat tram systems, and the like. The guidance members which guide the roller tube 24, such as swing arms or tracks, may be mounted to a variety of boat lifts and other supports.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A watercraft lift for lifting and lowering a watercraft having sides and a bottom, with a bow and a stern, the watercraft lift being positionable in a body of water, comprising:

a freestanding frame having a front end and a rear end;

at least one watercraft support movably connected to the frame and movable between a lowered support position and a raised support position, the watercraft support being arranged to engage and lift the watercraft when positioned thereon between the lowered support position and the raised support position;

port and starboard pivot arms, each having a lower end portion pivotally movably attached to the frame and an upper end portion, the port and starboard pivot arms being pivotally movable between a forward position wherein the upper end portions of the port and starboard pivot arms are positioned toward the bow of the watercraft when supported by the watercraft support in the raised support position and a rearward position wherein the upper end portions of the port and starboard pivot arms are positioned toward the stern of the watercraft when supported by the watercraft support in the raised support position;

at least one actuation member operatively connected to the port and starboard pivot arms to selectively and in unison pivotally move the port and starboard pivot arms between the forward and rearward positions;

a roller having a port end portion rotatably supported by the upper end portion of the port pivot arm and a starboard end portion rotatably supported by the upper end portion of the starboard pivot arm for travel with the upper end portions of the port and starboard pivot arms as they are pivotally moved between the forward and rearward positions;

a roller actuation member operatively connected to the roller to apply a rotational force thereto as the upper end portions of the port and starboard pivot arms are pivotally moved from the rearward position to the forward position;

a forwardly extending securing member having a rearward end portion attached to the frame at a location lower than the bow of the watercraft and a forward end potion positioned lower and below the bow of the watercraft when the watercraft is positioned on the watercraft support with the watercraft support in the lowered support position;

a watercraft cover sized to lengthwise extend over the watercraft, the cover having a forward end portion and a rearward end portion, and port and starboard side cover portions, the port side cover portion being sized to cover substantially the full port side of the watercraft and the starboard side cover portion being sized to cover substantially the full starboard side of the watercraft when the port and starboard pivot arms are moved to the rearward position and the watercraft is supported by the watercraft support in the raised support, the cover having a port side pocket extending along an edge portion of the port side cover portion and a starboard side pocket extending along an edge portion of the starboard side cover portion;

an elongated and elastic perimeter member extending about a portion of the perimeter of the cover from a position toward the forward end portion of the cover to a position toward the rearward end portion of the cover, the perimeter member having a port side portion extending through the port side pocket of the cover and terminating in an end portion and a starboard side portion extending through the starboard side pocket of the cover and terminating is an end portion, the end portions of the port and starboard side member portions of the perimeter member being attached to the roller, the length of the port and starboard side portions of the perimeter member being sized such that as the cover is unwound from the roller as the upper end portions of the port and starboard pivot arms are pivotally moved from the forward position to the rearward position and the port and starboard pivot arms approach the rearward position, the port and starboard side portions of the perimeter member are stretched into a taut state such that the taut port and starboard side portions of the perimeter member apply downward force along the length of the port and starboard edge portions of the port and starboard side portions of the cover to pull the cover downward over the watercraft as the upper end portions of the port and starboard pivot arms are pivotally moved into the rearward position when the watercraft is supported by the watercraft support in the raised support position;

a flexible first attachment member having a first portion attached to the forward end portion of the cover and a second portion attached to the securing member, the flexible first attachment member comprising a flexible port attachment member having a first portion attached to a port side of the forward end portion of the cover and a second portion attached to the securing member, and a flexible starboard attachment member having a first portion attached to a starboard side of the forward end portion of the cover and a second portion attached to the securing member;

an elastic second attachment member having a first portion attached to the rearward end portion of the cover and a second portion attached to the roller, the length of the elastic second attachment member being sized such that as the port and starboard pivot arms approach the rearward position, the elastic second attachment member is stretched sufficiently to apply a rearward force on the rearward end portion of the cover sufficient to place the cover in a taut state; and wherein the cover is wound about the roller when the upper end portions of the port and starboard pivot arms are in the forward position with the flexible first attachment member attached to the forward end portion of the cover and to the securing member, and progressively unwinds from the roller and is placed in position extending lengthwise covering the watercraft as the upper end portions of the port and starboard pivot arms are pivotally moved from the forward position to the rearward position when the watercraft is supported by the watercraft support in the raised support position, and wherein the cover is progressively wound about the roller and removed from covering the watercraft by the rotational force applied to the roller by the roller actuation member as the upper end portions of the port and starboard pivot arms are pivotally moved from the rearward position to the forward position when the watercraft is supported by the watercraft support in the raised support position.

2. The watercraft lift of claim of claim 1 wherein the forward end portion of the cover includes port and starboard wings to which the first portion of the first attachment member is attached.

3. The watercraft lift of claim 1 further including a spreader member extending between and spacing apart the port attachment member and the starboard attachment member at a position above the securing member.

4. The watercraft lift of claim 1 wherein the forward end portion of the cover forms a pocket sized to receive the bow of the watercraft therein, and the first attachment member comprises a port member attached to a port side of the forward end portion of the cover rearward of the pocket and a starboard member attached to a starboard side of the forward end portion of the cover rearward of the pocket.

5. The watercraft lift of claim 1 wherein the securing member includes a bow sprit having a forward end portion to which the second portion of the flexible first attachment member is attached and a rearward end portion attached to the frame, the forward end portion of the bow sprit being centrally located and below the bow of the watercraft when the watercraft is positioned on the watercraft support.

6. The watercraft lift of claim 1 wherein the cover has internal handles.

7. The watercraft lift of claim 1 wherein when the port and starboard pivot arms are moved to the forward position the roller is located forward of the bow of the watercraft when supported by the watercraft support in the raised support position, and when the port and starboard pivot arms are moved to the rearward position the roller is located rearward of the stern of the watercraft and lower than fifty percent of the port and starboard sides of the watercraft when supported by the watercraft support in the raised support position.

8. The watercraft lift of claim 1 wherein when the port and starboard arms are moved to the forward position the roller is located forward of the bow of the watercraft when supported by the watercraft support in the raised support position, and when the port and starboard arms are moved to the rearward position the roller is located rearward of the stern of the watercraft and at or below the waterline of the watercraft when supported by the watercraft support in the raised support position.

9. The watercraft lift of claim 1 wherein the cover is wound about the roller in a first rotational direction when the upper end portions of the port and starboard pivot arms are in the forward position, and the length of the port and starboard side portions of the perimeter member are sized such that as the cover is unwound from the roller as the upper end portions of the port and starboard pivot arms are pivotally moved from the forward position to the rearward position and the port and starboard pivot arms approach the rearward position, the end portions of the port and starboard side portions of the perimeter member are wound around the roller in a second rotational direction opposite the first rotational direction sufficient to stretch the port and starboard side portions of the perimeter member into the taut state such that the taut port and starboard side portions of the perimeter member apply downward force along the length of the port and starboard edge portions of the port and starboard side portions of the cover to pull the cover downward over the watercraft as the upper end portions of the port and starboard pivot arms are pivotally moved into the rearward position when the watercraft is supported by the watercraft support in the raised support position.

10. The watercraft lift of claim 1 wherein the perimeter member is adjustable.

11. The watercraft lift of claim 5 wherein the forward end portion of the bow sprit is located below the water line and below the bottom of the watercraft when the watercraft is positioned on the watercraft support with the watercraft support in the lowered support position and the watercraft lift positioned in the body of water.

12. The watercraft lift of claim 1 wherein the actuation member operatively connected to the port and starboard pivot arms includes at least one hydraulic cylinder.

13. The watercraft lift of claim 12 wherein further including a single control configured to switch automatically from a lifting mode controlling the watercraft support lifting of the watercraft between the lowered support position and the raised support position, and a cover mode controlling the actuation member operatively connected to the port and starboard pivot arms.

14. The watercraft lift of claim 1 further including a remote control which is capable of remotely controlling the operation of the actuation member operatively connected to the port and starboard pivot arms.

15. The watercraft lift of claim 1 wherein the actuation member operatively connected to the port and starboard pivot arms includes a port hydraulic cylinder connected to the port pivot arm for pivoting of the port pivot arm and a starboard hydraulic cylinder connected to the starboard pivot arm for pivoting of the starboard pivot arm.

16. The watercraft lift of claim 15 further including a hydraulic flow divider connected to the port and starboard hydraulic cylinders to control the port and starboard hydraulic cylinders for pivoting of the port and starboard pivot arms in unison.

17. The watercraft lift of claim 1 wherein the upper end portion of each of the port and starboard pivot arms is selectively lengthwise adjustable relative to the upper end portion to adjust the length of the port and starboard pivot arms.

18. The watercraft lift of claim 1 wherein the frame location of the lower end portion pivotal attachment to the frame of each of the port and starboard pivot arms is selectively longitudinally adjustable along a portion of the frame.

19. The watercraft lift of claim 1 wherein the actuation member operatively connected to the port and starboard pivot arms includes a port hydraulic cylinder connected to the port pivot arm for pivoting of the port pivot arm and having a lower end portion pivotally attached to the frame and a starboard hydraulic cylinder connected to the starboard pivot arm for pivoting of the starboard pivot arm and having a lower end portion pivotally attached to the frame, the frame attachment locations of the lower end portions of the port and starboard hydraulic cylinders are selectively adjustable along a portion of the frame.

20. A watercraft lift for lifting and lowering a watercraft having sides and a bottom, with a bow and a stern, the watercraft lift being positionable in a body of water, comprising:

a freestanding frame having a front end and a rear end;

at least one watercraft support movably connected to the frame and movable between a lowered support position and a raised support position, the watercraft support being arranged to engage and lift the watercraft when positioned thereon between the lowered support position and the raised support position;

port and starboard pivot arms, each having a lower end portion pivotally movably attached to the frame and an upper end portion, the port and starboard pivot arms being pivotally movable between a forward position wherein the upper end portions of the port and starboard pivot arms are positioned toward the bow of the watercraft when supported by the watercraft support in the raised support position and a rearward position wherein the upper end portions of the port and starboard pivot arms are positioned toward the stern of the watercraft when supported by the watercraft support in the raised support position;

at least one actuation member operatively connected to the port and starboard pivot arms to selectively and in unison pivotally move the port and starboard pivot arms between the forward and rearward positions;

a roller having a port end portion rotatably supported by the upper end portion of the port pivot arm and a starboard end portion rotatably supported by the upper end portion of the starboard pivot arm for travel with the upper end portions of the port and starboard pivot arms as they are pivotally moved between the forward and rearward positions;

a roller actuation member operatively connected to the roller to apply a rotational force thereto as the upper end portions of the port and starboard pivot arms are pivotally moved from the rearward position to the forward position;

a watercraft cover sized to lengthwise extend over the watercraft, the cover having a forward end portion and a rearward end portion, and port and starboard side portions, the port side portion being sized to cover substantially the full port side of the watercraft and the starboard side portion being sized to cover substantially the full starboard side of the watercraft when the port and starboard pivot arms are moved to the rearward position and the watercraft is supported by the watercraft support in the raised support position;

a first attachment member having a first portion attached to the forward end portion of the cover and a second portion attached to a securing member, the first attachment member comprises a flexible port attachment member having a first portion attached to a port side of the forward end portion of the cover and a second portion attached to the securing member, and a flexible starboard attachment member having a first portion attached to a starboard side of the forward end portion of the cover and a second portion attached to the securing member;

a second attachment member having a first portion attached to the rearward end portion of the cover and a second portion attached to the roller; and wherein the cover is wound about the roller when the upper end portions of the port and starboard pivot arms are in the forward position with the first attachment member attached to the forward end portion of the cover and to the securing member, and progressively unwinds from the roller and is placed in position extending lengthwise covering the watercraft as the upper end portions of the port and starboard pivot arms are pivotally moved from the forward position to the rearward position when the watercraft is supported by the watercraft support in the raised support position, and wherein the cover is progressively wound about the roller and removed from covering the watercraft by the rotational force applied to the roller by the roller actuation member as the upper end portions of the port and starboard pivot arms are pivotally moved from the rearward position to the forward position when the watercraft is supported by the watercraft support in the raised support position.

21. The watercraft lift of claim 20 wherein when the port and starboard pivot arms are moved to the forward position the roller is located forward of the bow of the watercraft when supported by the watercraft support in the raised support position, and when the port and starboard pivot arms are moved to the rearward position the roller is located rearward of the stern of the watercraft and lower than fifty percent of the port and starboard sides of the watercraft when supported by the watercraft support in the raised support position.

22. The watercraft lift of claim 20 wherein the securing member is attached to the frame at a location lower than the bow of the watercraft and below the water line when the watercraft is positioned on the watercraft support with the watercraft support in the lowered support position and the watercraft lift positioned in the body of water.

23. The watercraft lift of claim 20 wherein the cover has a port side pocket extending along an edge portion of the port side portion and a starboard side pocket extending along an edge portion of the starboard side portion, and the watercraft lift further includes an elongated and elastic perimeter member extending about a portion of the perimeter of the cover from a position toward the forward end portion of the cover to a position toward the rearward end portion of the cover, the perimeter member having a port side portion extending through the port side pocket of the cover and terminating in an end portion and a starboard side portion extending through the starboard side pocket of the cover and terminating is an end portion, the end portions of the port and starboard side portions of the perimeter member being attached to the roller, the length of the port and starboard side portions being sized such that as the cover is unwound from the roller as the upper end portions of the port and starboard pivot arms are pivotally moved from the forward position to the rearward position and the port and starboard pivot arms approach the rearward position, the port and starboard side portions of the perimeter member are stretched into a taut state such that the taut port and starboard side portions of the perimeter member apply downward force along the length of the port and starboard edge portions of the port and starboard side portions of the cover to pull the cover downward over the watercraft as the upper end portions of the port and starboard pivot arms are pivotally moved into the rearward position when the watercraft is supported by the watercraft support in the raised support position.

24. The watercraft lift of claim 23 wherein the cover is wound about the roller in a first rotational direction when the upper end portions of the port and starboard pivot arms are in the forward position, and the length of the port and starboard side portions of the perimeter portion are sized such that as the cover is unwound from the roller as the upper end portions of the port and starboard pivot arms are pivotally moved from the forward position to the rearward position and the port and starboard pivot arms approach the rearward position, the end portions of the port and starboard side portions of the perimeter member are wound about the roller in a second rotational direction opposite the first rotational direction sufficient to stretch the port and starboard side portions of the perimeter member into the taut state such that the taut port and starboard side portions of the perimeter member apply downward force along the length of the port and starboard edge portions of the port and starboard side portions of the cover to pull the cover downward over the watercraft as the upper end portions of the port and starboard pivot arms are pivotally moved into the rearward position when the watercraft is supported by the watercraft support in the raised support position.

25. The watercraft lift of claim 20 wherein the cover is wound about the roller in a first rotational direction when the upper end portions of the port and starboard pivot arms are in the forward position, and the watercraft lift further includes an elongated and elastic perimeter member extending about a portion of the perimeter of the cover from a position toward the forward end portion of the cover to a position toward the rearward end portion of the cover, the perimeter member having a port side portion engaging the edge portion of the port side portion of the cover and terminating in an end portion and a starboard side portion engaging the edge portion of the starboard side portion of the cover and terminating is an end portion, the end portions of the port and starboard side portions of the perimeter member being attached to the roller, the length of the port and starboard side portions being sized such that as the cover is unwound from the roller as the upper end portions of the port and starboard pivot arms are pivotally moved from the forward position to the rearward position and the port and starboard pivot arms approach the rearward position, the end portions of the port and starboard side portions of the perimeter member are wound about the roller in a second rotational direction opposite the first rotational direction sufficient to stretch the port and starboard side portions of the perimeter member into a taut state such that the taut port and starboard side portions of the perimeter member apply downward force along the length of the port and starboard edge portions of the port and starboard side portions of the cover to pull the cover downward over the watercraft as the upper end portions of the port and starboard pivot arms are pivotally moved into the rearward position when the watercraft is supported by the watercraft support in the raised support position.

26. The watercraft lift of claim 20 further including an elongated and elastic perimeter member extending about a portion of the perimeter of the cover from a position toward the forward end portion of the cover to a position toward the rearward end portion of the cover, the perimeter member engaging the port and starboard side portions of the cover and terminating in port and starboard end portions attached to the roller, the perimeter member being sized in length such that as the cover is unwound from the roller as the upper end portions of the port and starboard pivot arms are pivotally moved from the forward position to the rearward position and the port and starboard pivot arms approach the rearward position, the perimeter member is stretched into a taut state such that the taut the perimeter member applies downward force to the port and starboard side portions of the cover to pull the cover downward over the watercraft as the upper end portions of the port and starboard pivot arms are pivotally moved into the rearward position when the watercraft is supported by the watercraft support in the raised support position.

27. The watercraft lift of claim 20 wherein the second attachment member is elastic and the length of the elastic second attachment member is sized such that as the port and starboard pivot arms approach the rearward position, the elastic second attachment member is stretched sufficiently to apply a rearward force on the rearward end portion of the cover sufficient to place the cover in a taut state.

28. The watercraft lift of claim 27 further including an elongated and elastic perimeter member extending about a portion of the perimeter of the cover from a position toward the forward end portion of the cover to a position toward the rearward end portion of the cover, the perimeter member being attached to port and starboard side portions of the cover and terminating in port and starboard end portions attached to the roller, the perimeter member being sized in length such that as the cover is unwound from the roller as the upper end portions of the port and starboard pivot arms are pivotally moved from the forward position to the rearward position and the port and starboard pivot arms approach the rearward position, the perimeter member is stretched into a taut state such that the taut the perimeter member applies downward force to the port and starboard side portions of the cover to pull the cover downward over the watercraft as the upper end portions of the port and starboard pivot arms are pivotally moved into the rearward position when the watercraft is supported by the watercraft support in the raised support position.

29. The watercraft lift of claim 20 wherein the roller actuation member is a torsion spring operatively connected to the roller to apply a rotational force thereto as the upper end portions of the port and starboard pivot arms are pivoted from the rearward position to the forward position, and wherein the cover is progressively wound about the roller and removed from covering the watercraft by the rotational force applied to the roller by the torsion spring as the upper end portions of the port and starboard pivot arms are pivoted from the rearward position to the forward position when the watercraft is supported by the watercraft support in the raised support position.

30. The watercraft lift of claim 20 wherein the first attachment member is flexible.

31. The watercraft lift of claim 20 further including a spreader member extending between and spacing apart the port attachment member and the starboard attachment member at a position above the securing member.

32. The watercraft lift of claim 20 wherein the second attachment member is elastic with the length of the elastic second attachment member being sized such that as the port and starboard pivot arms approach the rearward position, the elastic second attachment member is stretched sufficiently to apply a rearward force on the rearward end portion of the cover sufficient to place the cover in a taut state.

33. The watercraft lift of claim 32 further including an elongated and elastic perimeter member extending about a portion of the perimeter of the cover from a position toward the forward end portion of the cover to a position toward the rearward end portion of the cover, the perimeter member being attached to port and starboard side portions of the cover and terminating in port and starboard end portions attached to the roller, the perimeter member being sized in length such that as the cover is unwound from the roller as the upper end portions of the port and starboard pivot arms are pivotally moved from the forward position to the rearward position and the port and starboard pivot arms approach the rearward position, the perimeter member is stretched into a taut state such that the taut the perimeter member applies downward force to the port and starboard side portions of the cover to pull the cover downward over the watercraft as the upper end portions of the port and starboard pivot arms are pivotally moved into the rearward position when the watercraft is supported by the watercraft support in the raised support position.

34. A watercraft lift for lifting and lowering a watercraft having sides and a bottom, with a bow and a stern, the watercraft lift being positionable in a body of water, comprising:

a freestanding frame having a front end and a rear end;

at least one watercraft support movably connected to the frame and movable between a lowered support position and a raised support position, the watercraft support being arranged to engage and lift the watercraft when positioned thereon between the lowered support position and the raised support position;

port and starboard arms, each having a lower end portion movably attached to the frame and an upper end portion, the port and starboard arms being movable between a forward position wherein the upper end portions of the port and starboard arms are positioned toward the bow of the watercraft when supported by the watercraft support in the raised support position and a rearward position wherein the upper end portions of the port and starboard arms are positioned toward the stern of the watercraft when supported by the watercraft support in the raised support position;

at least one actuation member operatively connected to the port and starboard arms to selectively and in unison move the port and starboard arms between the forward and rearward positions;

a roller having a port end portion rotatably supported by the upper end portion of the port arm and a starboard end portion rotatably supported by the upper end portion of the starboard arm for travel with the upper end portions of the port and starboard arms as they moved between the forward and rearward positions;

a roller actuation member operatively connected to the roller to apply a rotational force thereto as the upper end portions of the port and starboard arms are moved from the rearward position to the forward position;

a watercraft cover sized to lengthwise extend over the watercraft, the cover having a forward end portion and a rearward end portion, and port and starboard side portions, the port side portion being sized to cover substantially the full port side of the watercraft and the starboard side portion being sized to cover substantially the full starboard side of the watercraft when the port and starboard arms are moved to the rearward position and the watercraft is supported by the watercraft support in the raised support position;

a first attachment member having a first portion attached to the forward end portion of the cover and a second portion attached to a securing member, the first attachment member comprising a flexible port attachment member having a first portion attached to a port side of the forward end portion of the cover and a second portion attached to the securing member, and a flexible starboard attachment member having a first portion attached to a starboard side of the forward end portion of the cover and a second portion attached to the securing member;

a second attachment member having a first portion attached to the rearward end portion of the cover and a second portion attached to the roller; and wherein the cover is wound about the roller when the upper end portions of the port and starboard arms are in the forward position with the first attachment member attached to the forward end portion of the cover and to the securing member, and progressively unwinds from the roller and is placed in position extending lengthwise covering the watercraft as the upper end portions of the port and starboard arms are moved from the forward position to the rearward position when the watercraft is supported by the watercraft support in the raised support position, and wherein the cover is progressively wound about the roller and removed from covering the watercraft by the rotational force applied to the roller by the roller actuation member as the upper end portions of the port and starboard arms are moved from the rearward position to the forward position when the watercraft is supported by the watercraft support in the raised support position.

35. The watercraft lift of claim 34 wherein when the port and starboard arms are moved to the forward position the roller is located forward of the bow of the watercraft when supported by the watercraft support in the raised support position, and when the port and starboard arms are moved to the rearward position the roller is located rearward of the stern of the watercraft and lower than fifty percent of the port and starboard sides of the watercraft when supported by the watercraft support in the raised support position.

36. The watercraft lift of claim 34 wherein the securing member is attached to the frame at a location lower than the bow of the watercraft and below the water line when the watercraft is positioned on the watercraft support with the watercraft support in the lowered support position and the watercraft lift positioned in the body of water.

37. The watercraft lift of claim 34 wherein the cover is wound about the roller in a first rotational direction when the upper end portions of the port and starboard arms are in the forward position, the cover having a port side pocket extending along an edge portion of the port side portion and a starboard side pocket extending along an edge portion of the starboard side portion, and the watercraft lift further includes an elongated and elastic perimeter member extending about a portion of the perimeter of the cover from a position toward the forward end portion of the cover to a position toward the rearward end portion of the cover, the perimeter member having a port side portion extending through the port side pocket of the cover and terminating in an end portion and a starboard side portion extending through the starboard side pocket of the cover and terminating is an end portion, the end portions of the port and starboard side portions of the perimeter member being attached to the roller, the length of the port and starboard side portions being sized such that as the cover is unwound from the roller as the upper end portions of the port and starboard arms are moved from the forward position to the rearward position and the port and starboard arms approach the rearward position, the end portions of the port and starboard side portions of the perimeter member are wound about the roller in a second rotational direction opposite the first rotational direction sufficient to stretch the port and starboard side portions of the perimeter member into a taut state such that the taut port and starboard side portions of the perimeter member apply downward force along the length of the port and starboard edge portions of the port and starboard side portions of the cover to pull the cover downward over the watercraft as the upper end portions of the port and starboard arms are moved into the rearward position when the watercraft is supported by the watercraft support in the raised support position.

38. The watercraft lift of claim 34 wherein the cover is wound about the roller in a first rotational direction when the upper end portions of the port and starboard arms are in the forward position, and the watercraft lift further includes an elongated and elastic perimeter member extending about a portion of the perimeter of the cover from a position toward the forward end portion of the cover to a position toward the rearward end portion of the cover, the perimeter member having a port side portion attached to the edge portion of the port side portion of the cover and terminating in an end portion and a starboard side portion attached to the edge portion of the starboard side portion of the cover and terminating is an end portion, the end portions of the port and starboard side portions of the perimeter member being attached to the roller, the length of the port and starboard side portions being sized such that as the cover is unwound from the roller as the upper end portions of the port and starboard arms are moved from the forward position to the rearward position and the port and starboard arms approach the rearward position, the end portions of the port and starboard side portions of the perimeter member are wound about the roller in a second rotational direction opposite the first rotational direction sufficient to stretch the port and starboard side portions of the perimeter member into a taut state such that the taut port and starboard side portions of the perimeter member apply downward force along the length of the port and starboard edge portions of the port and starboard side portions of the cover to pull the cover downward over the watercraft as the upper end portions of the port and starboard arms are moved into the rearward position when the watercraft is supported by the watercraft support in the raised support position.

39. The watercraft lift of claim 34 further including an elongated and elastic perimeter member extending about a portion of the perimeter of the cover from a position toward the forward end portion of the cover to a position toward the rearward end portion of the cover, the perimeter member being attached to port and starboard side portions of the cover and terminating in port and starboard end portions attached to the roller, the perimeter member being sized in length such that as the cover is unwound from the roller as the upper end portions of the port and starboard arms are moved from the forward position to the rearward position and the port and starboard arms approach the rearward position, the perimeter member is stretched into a taut state such that the taut the perimeter member applies downward force to the port and starboard side portions of the cover to pull the cover downward over the watercraft as the upper end portions of the port and starboard arms are moved into the rearward position when the watercraft is supported by the watercraft support in the raised support position.

40. The watercraft lift of claim 34 wherein the second attachment member is elastic and the length of the elastic second attachment member is sized such that as the port and starboard arms approach the rearward position, the elastic second attachment member is stretched sufficiently to apply a rearward force on the rearward end portion of the cover sufficient to place the cover in a taut state.

41. The watercraft lift of claim 40 further including an elongated and elastic perimeter member extending about a portion of the perimeter of the cover from a position toward the forward end portion of the cover to a position toward the rearward end portion of the cover, the perimeter member being attached to port and starboard side portions of the cover and terminating in port and starboard end portions attached to the roller, the perimeter member being sized in length such that as the cover is unwound from the roller as the upper end portions of the port and starboard arms are moved from the forward position to the rearward position and the port and starboard arms approach the rearward position, the perimeter member is stretched into a taut state such that the taut the perimeter member applies downward force to the port and starboard side portions of the cover to pull the cover downward over the watercraft as the upper end portions of the port and starboard arms are moved into the rearward position when the watercraft is supported by the watercraft support in the raised support position.

42. The watercraft lift of claim 34 wherein the roller actuation member is a torsion spring operatively connected to the roller to apply a rotational force thereto as the upper end portions of the port and starboard arms are moved from the rearward position to the forward position, and wherein the cover is progressively wound about the roller and removed from covering the watercraft by the rotational force applied to the roller by the torsion spring as the upper end portions of the port and starboard arms are moved from the rearward position to the forward position when the watercraft is supported by the watercraft support in the raised support position.

43. The watercraft lift of claim 34 wherein the first attachment member is flexible.

44. The watercraft lift of claim 34 further including a spreader member extending between and spacing apart the port attachment member and the starboard attachment member at a position above the securing member.

45. The watercraft lift of claim 34 wherein the second attachment member is elastic with the length of the elastic second attachment member being sized such that as the port and starboard arms approach the rearward position, the elastic second attachment member is stretched sufficiently to apply a rearward force on the rearward end portion of the cover sufficient to place the cover in a taut state.

46. The watercraft lift of claim 45 further including an elongated and elastic perimeter member extending about a portion of the perimeter of the cover from a position toward the forward end portion of the cover to a position toward the rearward end portion of the cover, the perimeter member being attached to port and starboard side portions of the cover and terminating in port and starboard end portions attached to the roller, the perimeter member being sized in length such that as the cover is unwound from the roller as the upper end portions of the port and starboard arms are moved from the forward position to the rearward position and the port and starboard arms approach the rearward position, the perimeter member is stretched into a taut state such that the taut the perimeter member applies downward force to the port and starboard side portions of the cover to pull the cover downward over the watercraft as the upper end portions of the port and starboard arms are moved into the rearward position when the watercraft is supported by the watercraft support in the raised support position.

* * * * *